US009757799B2

(12) United States Patent
Nitzl et al.

(10) Patent No.: US 9,757,799 B2
(45) Date of Patent: Sep. 12, 2017

(54) SUBMERGED ENTRY NOZZLE

(71) Applicant: REFRACTORY INTELLECTUAL PROPERTY GMBH & CO. KG, Vienna (AT)

(72) Inventors: Gerald Nitzl, Baden (AT); Hans-Jurgen Haslinger, Trieben (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 0 days.

(21) Appl. No.: 14/655,595

(22) PCT Filed: Jan. 6, 2014

(86) PCT No.: PCT/EP2014/050083

§ 371 (c)(1),
(2) Date: Jul. 24, 2015

(87) PCT Pub. No.: WO2014/127921

PCT Pub. Date: Aug. 28, 2014

(65) Prior Publication Data

US 2015/0352636 A1 Dec. 10, 2015

(30) Foreign Application Priority Data

Feb. 25, 2013 (EP) ..... 13156506

(51) Int. Cl.
*B22D 41/50* (2006.01)

(52) U.S. Cl.
CPC ..... *B22D 41/50* (2013.01); *B22D 41/507* (2013.01)

(58) Field of Classification Search
CPC ..... B22D 41/50; B22D 41/507
USPC ..... 222/591, 594, 600, 606, 607; 266/236; 164/488, 437, 489
See application file for complete search history.

(56) References Cited

U.S. PATENT DOCUMENTS

| | | | | |
|---|---|---|---|---|
| 5,046,647 A * | 9/1991 | Kawai | B22D 41/54 | 222/591 |
| 6,321,953 B1 * | 11/2001 | Nakamura | B22D 41/50 | 222/606 |
| 6,543,656 B1 * | 4/2003 | Sahai | B22D 11/103 | 164/437 |
| 2013/0098952 A1 * | 4/2013 | Richaud | B22D 41/50 | 222/591 |

FOREIGN PATENT DOCUMENTS

| | | | |
|---|---|---|---|
| DE | 2442915 A1 | 3/1975 | |
| EP | 0264809 * | 4/1988 | B22D 41/50 |

(Continued)

OTHER PUBLICATIONS

International Search Report for App. No. PCT/EP2014/050083 dated Oct. 9, 2014.

*Primary Examiner* — Scott Kastler
*Assistant Examiner* — Michael Aboagye
(74) *Attorney, Agent, or Firm* — Medley, Behrens & Lewis, LLC

(57) ABSTRACT

An exemplary embodiment relates to a submerged entry nozzle (SEN) for use in metallurgy, in particular for transporting a metal melt from a first metallurgical unit to a second metallurgical unit, for example during slab production in continuous casting of ferrous and non-ferrous melts. The SEN is called nozzle hereinafter.

5 Claims, 7 Drawing Sheets

(56) References Cited

FOREIGN PATENT DOCUMENTS

Figure 1:
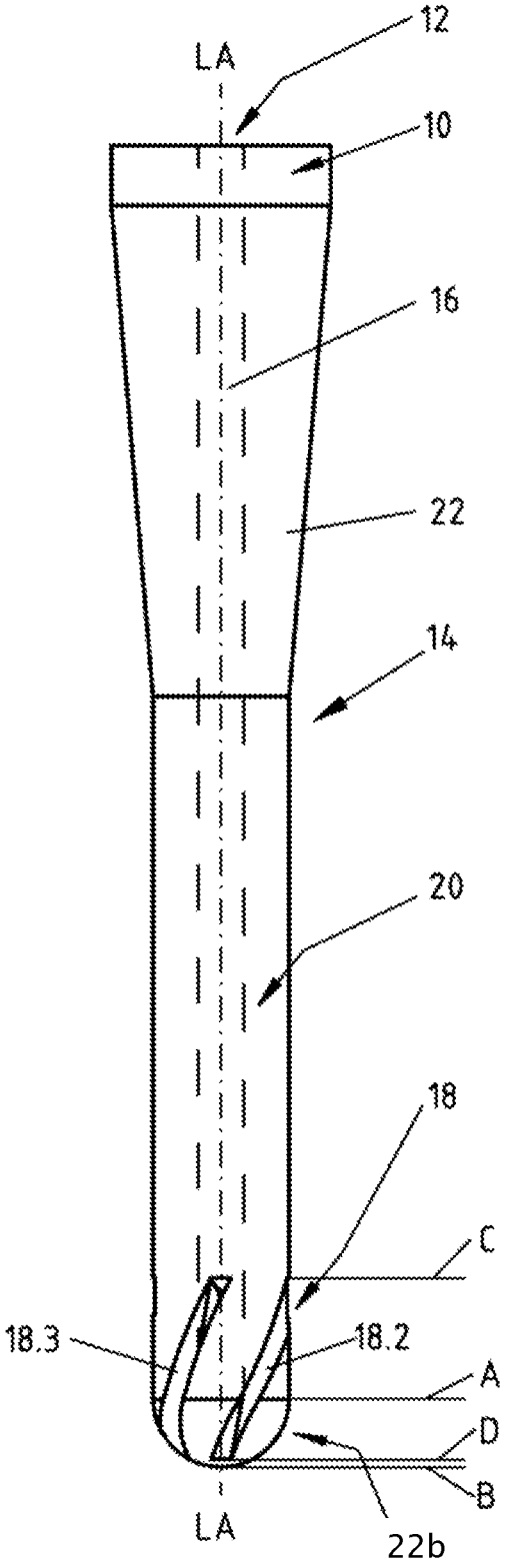

| | | | | | |
|---|---|---|---|---|---|
| EP | 0264809 | A1 | | 4/1988 | |
| JP | 55149753 | | * | 11/1980 | ..... B22D 41/50 |
| JP | S5877754 | A | | 5/1983 | |
| SU | 1565573 | A1 | | 5/1990 | |
| WO | WO 2012003047 | | * | 1/2012 | ..... B22D 41/50 |

* cited by examiner

SUBMERGED ENTRY NOZZLE

The invention relates to a submerged entry nozzle (SEN) for use in metallurgy, in particular for transporting a metal melt from a first metallurgical unit to a second metallurgical unit, for example during slab production in continuous casting of ferrous and non-ferrous melts. The SEN is called nozzle hereinafter.

As far as the design of such a submerged entry nozzle (SEN) is described hereinafter reference is made to the use-position (casting position) of the nozzle, when a stream of fluid metal passes the said nozzle in a substantially vertical and downward direction.

A submerged entry nozzle of generic type is known from DE 24 42 915 A and serves for transporting a metal melt from a tundish to an ingot mold.

Its general design is as follows: the nozzle comprises a tubular body with a central longitudinal axis. It may be defined by three sections:

a) an upper section comprising an inlet opening (entry port)

b) a central section, comprising a passageway for the melt, which passageway extends from the entry port to an outlet port. Insofar the passageway is delimited circumferentially by the inner surface of the nozzle wall. This nozzle wall comprises two outlet openings at opposite sides (in a horizontal direction). The outlet openings, forming the outlet port, extend from the inner surface of the nozzle wall to the outer surface of the nozzle wall. The outlet openings are arranged along the wall portion of the central section and extend substantially radially with respect to the central longitudinal axis of the nozzle or the vertical part of the passageway respectively, c) a lower nozzle section, characterized in that it does not comprise any passageway and/or outlet openings. It is solid and made of a refractory ceramic material. Typically this bottom section is either flat (planar) and then mostly perpendicular to the central longitudinal nozzle axis or curved, e.g. convex (seen from below) at its lowermost part.

In the latter case the said bottom section may be defined as well as that part of the nozzle with a horizontal cross section smaller than the horizontal cross section of an adjacent upper part of the nozzle.

The curved bottom design represents a so called "nose portion" of the nozzle, being defined in DE 24 42 915 A as that part of nozzle at a distance beneath the lower end of the lateral/radial outlet openings.

Both the upper and central sections, made of a refractory ceramic material, may have a cylindrical shape. Depending on its use at least the lower part of the central section, and correspondingly the lower nozzle section, may have a cylindrical shape as the other sections or designed differently, for example with a non-circular cross-section, for example oval, rectangular or the like. This design is used inter alia in thin slab casting processes and represented as well by DE 24 42 915 A.

With this type of a nozzle the metal stream flows via said inlet opening (inlet port) into said passageway and leaves said passageway through said two outlet openings (outlet ports) in a radial (lateral) direction (in other words: in a direction perpendicular to the central longitudinal axis of the nozzle).

As described in DE 24 42 915 A this radial outflow may cause problems as the metal stream, after escaping the nozzle outlet port, hits the adjacent wall of the ingot mold, thereby causing undesired wear of a thin solidified outer shell of the strand.

To avoid such impact wear DE 24 42 915 A1 discloses a cage-like intermediate barrier system between the respective outlet opening and the inner surface of the mold. While any direct impact of the metal stream onto the mold and/or the outer shell of the strand may thus be avoided it cannot effectively reduce turbulences of the metal upon leaving the nozzle outlet port or shortly thereafter along its way into the associated metallurgical vessel (like a mold). In contrary, turbulences of the metal melt are even increased by this system, causing further problems and arbitrary solidification of the melt in the upper part (entrance section) of the mold.

To improve the homogeneity of the melt and its solidification, in particular to avoid arbitrary solidification of the outer shell of the (metallic) strand during casting, it is known from practice to install an electromagnetic stirrer around the metal stream at a distance below the nozzle bottom, which gives the strand a certain angular momentum (angle of twist).

This systems mostly works reasonable but needs corresponding installation and investment. In case of a metal stream, arriving with an opposite twist at the stirrer region, no real advantages may be achieved.

It is the object of the invention to provide an alternative system allowing a continuous metal flow (of constant physical features like viscosity) from one metallurgical unit into another and especially via a nozzle into a subsequent ingot mold.

To overcome the described drawbacks of prior art devices the invention is based on the following considerations:

The most important factor for improvements is the direction of the melt upon and after leaving the nozzle. The melt flow within the nozzle, namely downwardly along the described central passageway, is predominantly vertical until it reaches the outlet opening(s). The melt flow is then redirected into a more or less horizontal direction (radial to the central longitudinal axis of the nozzle), as described above, to penetrate the outlet openings, before it turns back into a predominantly vertical direction when and/or after it enters the upper part of the mold arranged around and beneath the lower nozzle section.

In other words: the melt flow is characterized by two more or less right-angled redirections (deviations).

One first and important aspect of the invention is to "soften" these discontinuities in the metal flow. This can be achieved—according to intensive investigations and water modeling tests—by extending the outlet port (outlet openings) from the (central) section of the nozzle into the bottom or "bottom section" of the nozzle.

In other words: The outlet port (outlet opening(s)) is enlarged in a longitudinal direction of the overall nozzle into the lower nozzle section and opens downwardly into its bottom section.

Contrary to the nozzle of DE 24 42 915 A the outlet opening extends into the bottom section (nose portion) of the nozzle independently of the shape of the nose portion (flat/planar or curved). The bottom of the new nozzle design is characterized in that it comprises the lower end of the at least one outlet opening.

By this design feature the corresponding (or each) outlet opening allows the metal melt to flow out not only in a more or less horizontal (and often radial) direction but as well in a vertical direction.

In other words: If the metal stream is characterized by vectors it now provides a considerable vertical vector component $V_v$ (besides the conventional horizontal vector component $V_H$). The relation between vertical and horizontal vector components ($V_v/V_H$), defining the flow direction of the metal stream, may be set by the respective lengths and widths of the outlet openings (outlet slits) along the central and bottom sections of the nozzle.

The enlargement of the outlet opening(s) into the bottom section of the nozzle reduces the "sharpness" of any redirections of the metal flow on its way from the nozzle into the associated metallurgical unit.

While the main volume of the melt may still escape the nozzle laterally via that part of the outlet openings arranged along the lower part of the central nozzle section the adjacent (extended) lowermost part of the outlet opening(s) urges the melt stream to turn into a vertical downward movement (direction) and to flow out with a corresponding downward orientation and twist.

It has been found that the outlet opening within the bottom part of the nozzle is responsible for a corresponding angular momentum of the melt stream.

The outlet openings may have various cross sectional pattern but a preferred one is a slit like pattern characterized with a longer elongation in a vertical direction than in a horizontal direction, wherein the relation may be >2:1, >3:1, >4:1, >5:1, >6:1, >7:1.

Typically the width (circumferentially) of both upper and lower part of the outlet openings is about the same.

A second aspect of the invention is the radial/lateral orientation of the outlet openings. Slit like openings inclined with respect to a plane parallel to a plane comprising the central longitudinal axis are preferred to achieve/enforce a stronger angular momentum within the metal flow.

An inclination with an angle $\alpha$ of >5°, >8°, >12°, >20°, >30° is most suitable, depending on the number and arrangement of the openings (in particular slits) as well as depending on the general design of the lower part of the central nozzle section. An angle between 5 and 45 degrees to a plane including the central longitudinal axis of the nozzle gives the metal stream a certain tangential flow direction, with angles between 10 and 30 degrees being preferred in most applications.

Opposing vertical bounding surfaces of each opening may be flat (planar) or curved, parallel to each other or with different inclination/curvature, depending on the angular momentum required.

The number of outlet openings is a further aspect to achieve a modified and improved outflow pattern. Prior art devices are characterized by two opposed outlet openings. Three outlet openings, offset to each other by 120 degrees, four, five, six or more outlet openings, preferably again offset to each other by the same angle, are optional features to influence the melt flow and its angular twist.

Based on this cognition the invention—in its most general embodiment—may be described by a submerged entry nozzle comprising the following features:

a substantially tubular body with a central longitudinal axis and a passageway extending from an inlet port at a first end of the nozzle, which is the upper end of the nozzle in its use position, towards a second end of the nozzle, which is the lower end of the nozzle in its use position, wherein the second end of the nozzle provides a bottom which is either flat or convex, when seen from the outside, wherein said passageway merges into at least one outlet port, which is designed as a long slit, which slit continuously extends from a position at a distance to the bottom into the said bottom.

In other words: While prior art nozzle were characterized by a closed bottom portion and any outlet openings were only arranged along the cylindrical wall portion of the lower part of central nozzle section the new design provides an outlet opening, the lower part of which being extended into the bottom part of the nozzle in order to allow the metal melt to flow out in an at least partially vertical flow direction and which extended outlet portion allows to provide the outflowing metal stream with a certain twist.

The slit may have long side walls extending in a plane which is parallel to a plane comprising the central longitudinal axis.

In an alternative the slit has long side walls extending in a plane arranged at an angle of <45 degrees to a plane comprising the central longitudinal axis to give the outflowing metal stream a certain twist.

The slit may have a linear extension, either vertical or with an angle to the vertical.

According to an embodiment the slit has a spiral or helix-like extension, which causes a further angular momentum into the outflowing metal stream.

The length and width of the slit may vary, depending on the nozzle and the casting conditions. The described advantages may be achieved to its best with one or more slits extending (in total) over 5-50% (typically 10-30%) of the surface of the nozzle bottom and/or a slit with a length, which is more than 3 times its width.

A considerable further improvement may be achieved with several slits, arranged at equal angles to each other along the outer periphery of the nozzle and preferred in a rotational symmetrical manner.

Further features of the invention may be derived from the sub-claims and the other application documents.

The invention will now be described with respect to the attached drawing which Shows—in schematic representations—in FIG. 1: a side view of a first embodiment of the new nozzle FIG. 2: an enlarged view of the nose portion of the nozzle of FIG. 1

Figure 2:
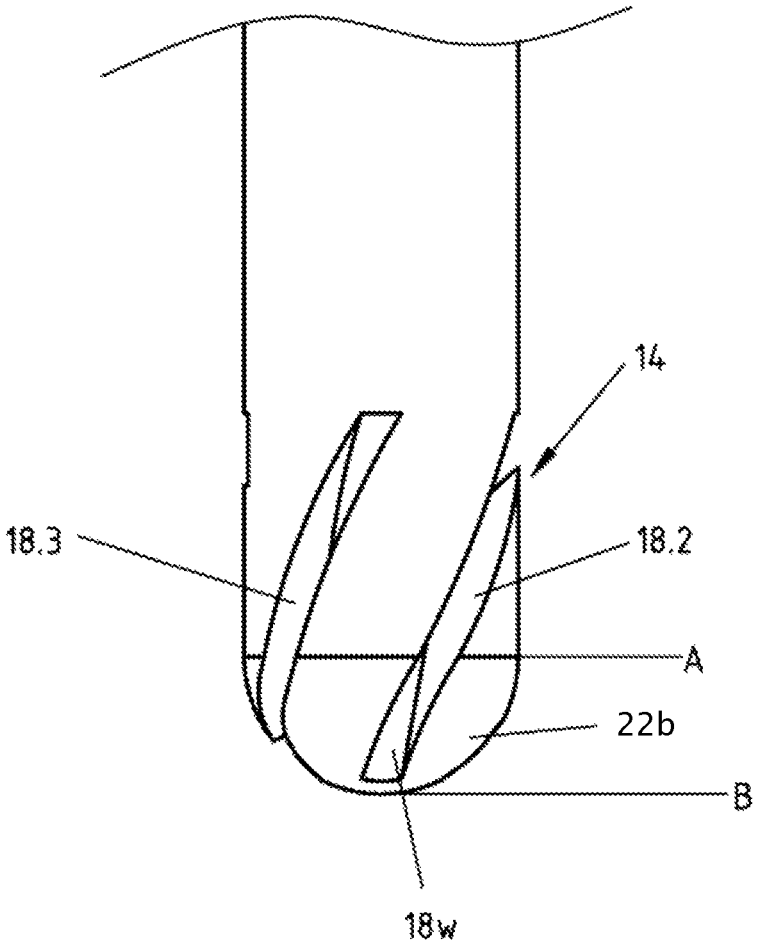
Figure 3:
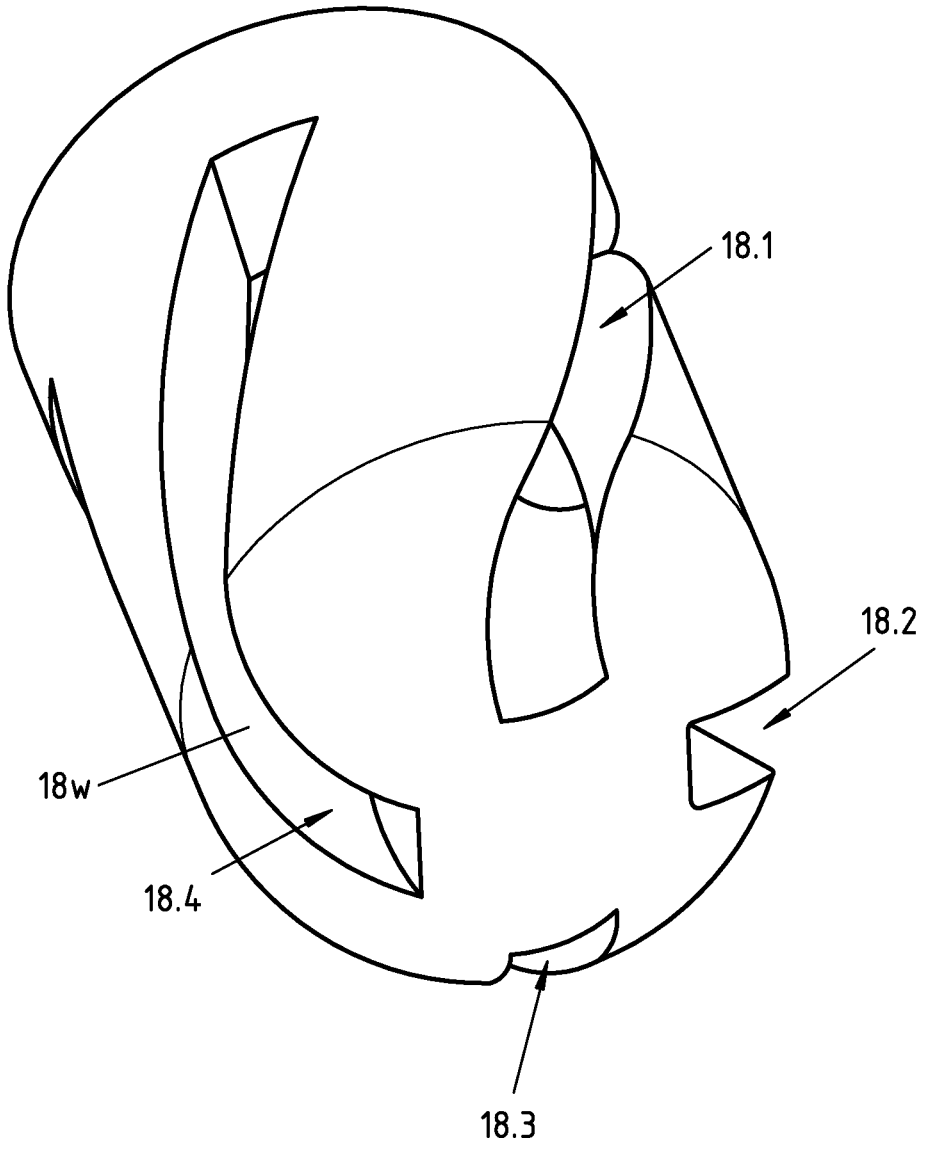

FIG. 3: a 3-dimensional view from below onto the nose portion according to FIG. 2

Figure 4:
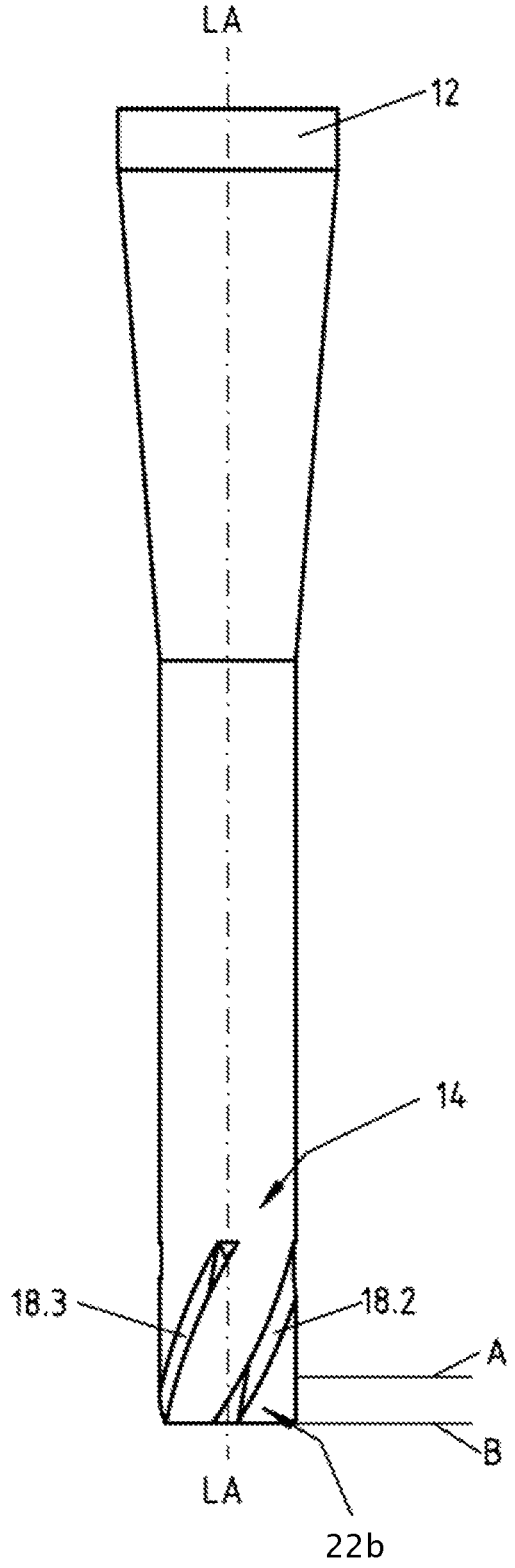

FIG. 4: a side view of a second embodiment of the new nozzle

Figure 5:
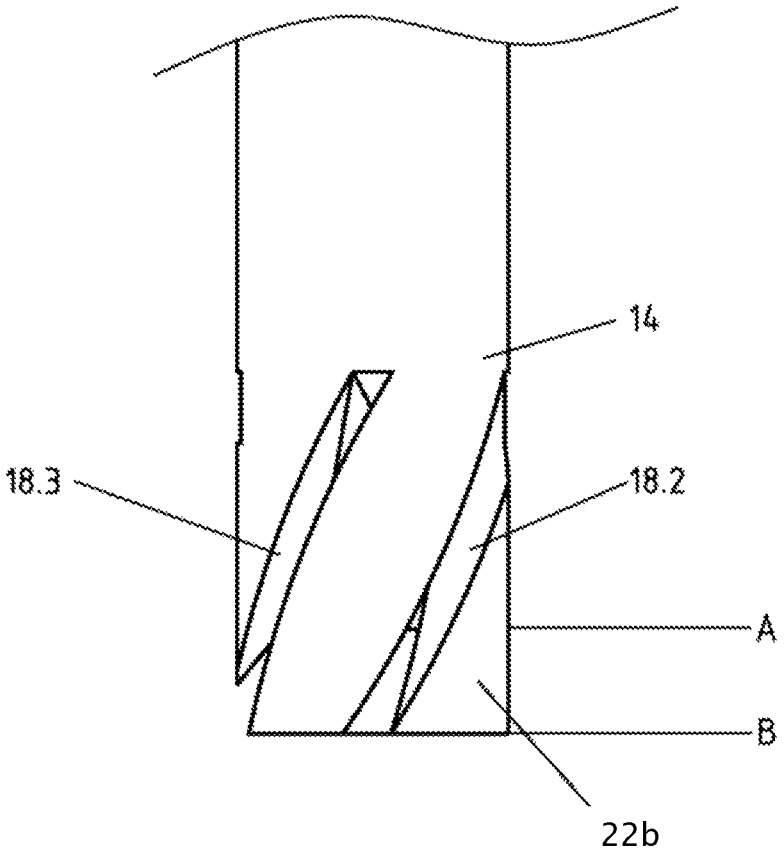

FIG. 5: an enlarged view of the nose portion of the nozzle of FIG. 4

Figure 6:
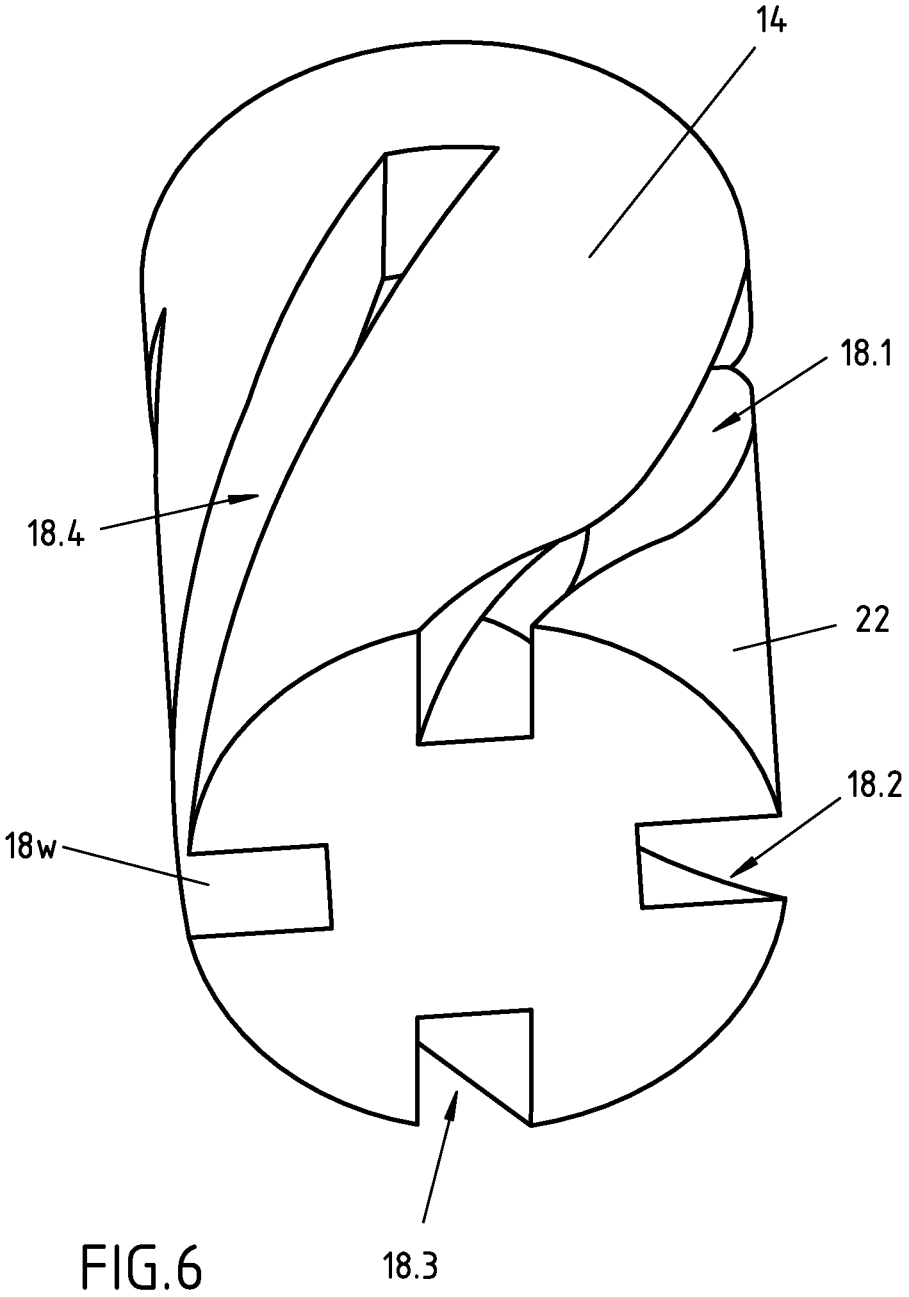

FIG. 6: a 3-dimensional view from below onto the nose portion according to FIG. 5

Figure 7:
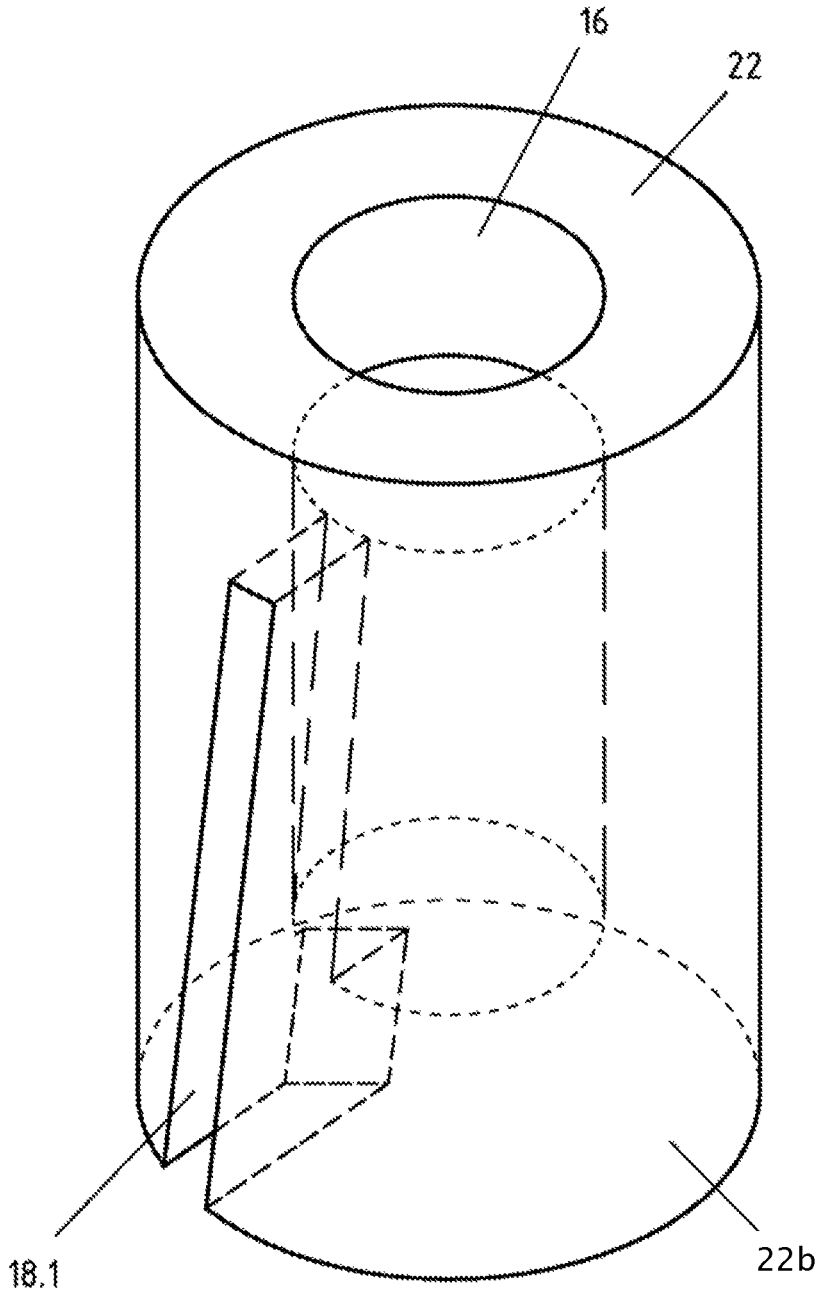

FIG. 7: a 3-dimensional view onto the lower central section and the bottom of a third embodiment of the new nozzle In the Figures same numerals are used to identify identical parts or parts of similar function (in technical terms)

FIG. 1 shows a submerged entry nozzle, shaped as a rod with a tubular body, comprising an upper section 10 with an inlet port 12, a central portion 14, comprising a passageway 16, which extends from said entry port 12 to an outlet port 18. The passageway 16 is delimited by an inner surface 20 of the refractory ceramic nozzle wall 22 (tubular body).

A lower bottom portion 22*b*, shaped like a dome (convex when seen from the outside) and extending from that part of the nozzle where the outer nozzle diameter diminishes (characterized by line A) to the lowermost end of the nozzle (characterized by line B).

The outlet port 18 is split into four slit-like outlet openings 18.1 . . . 18.4 (FIG. 3) arranged at equal distance to each other around the outer nozzle wall 22.

Each slit 18.1 . . . 18.4:

extends from an upper end (characterized by line C), arranged in the lower zone of the central section 14 into the bottom 22*b* and further downwardly to an area characterized by line D, has a length, with is about 10 times its width, has a helical/spiral/helix shape between upper and lower end, has side walls 18*w* which are parallel to a plane comprising a central longitudinal axis LA of the nozzle.

Thus the metal enters the nozzle via 12, flows through passageway 16 towards the lower end of said nozzle and leaves the nozzle by its four slit-like outlet openings 18.1 . . . 18.4.

Because of the shape and arrangement of these slits 18.1 . . . 18.4 the metal stream, leaving the nozzle, has a vertical (downward) flow component (mainly caused by the lower part of the slits in the bottom section 22*b*) as well as an angular momentum (mainly caused by the helix shape of the slits 18.1 . . . 18.4 and the lower part of the slits in the bottom section 22*b*), which reduces turbulences and collisions with an adjacent wall of a corresponding mold.

The embodiment of FIGS. 4-6 differs from that of FIG. 1-3 as the bottom 22*b* is flat, in this embodiment perpendicular to axis LA, wherein upper and lower end of bottom section 22*b* are defined by the upper and lower flat surfaces of the bottom and symbolized again by lines A, B in accordance with FIG. 1-3.

The lower part of outlet slits 18.1 . . . 18.4 extends along said horizontal bottom 22*b* (FIG. 6) i.e. it penetrates said bottom 22*b*, thus giving the melt a strong vertical and twist component when leaving these bottom openings.

FIG. 7 disclosed an embodiment similar to that of FIG. 4-6 with the following differences:

it comprises only one slit 18.1 said slit 18.1 has a linear extension said slit 18.1 and its side walls are tilted with respect to the vertical The embodiment according to FIG. 7 may be amended inter alia by implementing 2 or more slits in accordance with FIG. 1-6 or in a different way.

The invention claimed is:

1. Submerged entry nozzle comprising a substantially tubular body with a central longitudinal axis (LA) and a passageway (16) extending from an inlet port (12) at a first end of the nozzle, which is the upper end of the nozzle in its use position, toward a second end of the nozzle, which is the lower end of the nozzle in its use position, wherein the second end of the nozzle provides a bottom (22*b*) which is either flat or convex, when seen from the outside, wherein said passageway (16) merges into at least one outlet port (18), which is designed as a long slit, wherein the slit has long side walls (18*w*) extending in a plane arranged at an angle of <45 degrees to a plane comprising the central longitudinal axis (LA), wherein the slit has a spiral or helix-like extension and continuously extends from a position at a distance to the bottom (22*b*) into the said bottom (22*b*), to allow a metal melt to flow out of the nozzle in a horizontal and in a vertical direction.

2. Submerged entry nozzle according to claim 1, wherein the slit has a linear extension.

3. Submerged entry nozzle according to claim 1, wherein 5-30% of the length of the slit extend within the bottom (22*b*) of the nozzle.

4. Submerged entry nozzle according to claim 1, wherein the slit has a length, which is more than 3 times its width.

5. Submerged entry nozzle according to claim 1, with several slits, arranged at equal angles to each other along the outer periphery of the nozzle.

* * * * *